US012310486B2

(12) United States Patent
Klein

(10) Patent No.: US 12,310,486 B2
(45) Date of Patent: May 27, 2025

(54) FINGER MOISTENER CONTAINER

(71) Applicant: David Klein, Bloomington, MN (US)

(72) Inventor: David Klein, Bloomington, MN (US)

( * ) Notice: Subject to any disclaimer, the term of this patent is extended or adjusted under 35 U.S.C. 154(b) by 0 days.

(21) Appl. No.: 17/700,661

(22) Filed: Mar. 22, 2022

(65) Prior Publication Data

US 2023/0012753 A1 Jan. 19, 2023

Related U.S. Application Data

(60) Provisional application No. 63/164,241, filed on Mar. 22, 2021.

(51) Int. Cl.

| | |
|---|---|
| ***B43M 11/06*** | (2006.01) |
| ***A45F 5/00*** | (2006.01) |
| ***A45F 5/02*** | (2006.01) |

(52) U.S. Cl.

CPC ..... *A45F 5/00* (2013.01); *A45F 5/02* (2013.01); *A45F 2005/008* (2013.01)

(58) Field of Classification Search

CPC ..... B43M 11/06; B43M 11/04; B43M 11/00; A63B 71/00; B05C 21/00; A45D 34/04; A45D 2200/1009

See application file for complete search history.

(56) References Cited

U.S. PATENT DOCUMENTS

| | | | | |
|---|---|---|---|---|
| 1,139,942 | A * | 5/1915 | Powell et al. | B43M 11/04 223/109 R |
| 2,356,722 | A * | 8/1944 | Harris | B43M 11/06 D11/27 |
| 2,490,650 | A * | 12/1949 | Reckler | A01K 97/00 401/6 |
| 3,741,377 | A * | 6/1973 | Krellen | A45C 11/005 220/834 |
| 4,411,040 | A * | 10/1983 | Sharrow | A63B 47/04 15/104.94 |
| 4,454,889 | A * | 6/1984 | Contreras, Sr. | A45D 40/22 220/829 |
| 8,506,158 | B2 * | 8/2013 | Keung | A44C 5/0084 368/282 |
| 10,188,186 | B2 * | 1/2019 | Norman | A45C 11/00 |
| 2008/0223889 | A1 * | 9/2008 | Rossell | A45F 5/00 224/222 |
| 2022/0047059 | A1 * | 2/2022 | Romiti | A45D 33/33 |

* cited by examiner

*Primary Examiner* — Adam J Waggenspack
(74) *Attorney, Agent, or Firm* — Husch Blackwell LLP

(57) ABSTRACT

A device for use in handling paper products. A finger moisturizer container can be worn on the wrist of a user via an adjustable wristband. Alternatively, the container can be located on a clip that can be attached to an article of clothing, cover or pages of a book. The device can be used to assist in the turning of pages of a book or magazine, sorting or separating stacks of money or other paper or like products.

18 Claims, 13 Drawing Sheets

FINGER MOISTENER CONTAINER

CROSS-REFERENCE TO RELATED APPLICATIONS

The present application claims the benefit of and priority to U.S. Provisional Application Ser. No. 63/164,241, filed Mar. 22, 2021, of which the entire contents are incorporated herein by reference.

TECHNICAL FIELD

The present disclosure relates generally to a device for use in handling paper products, and more particularly to the device to assist in turning the pages of a book or magazine, sorting or separating stacks of money, paper, and the like.

BACKGROUND

In the handling of paper the fingertip plays an integral role in the turning pages of books, magazines or coloring books, handling flash cards or playing cards. The paper is moved by a frictional force interacting between the paper the fingertip, where the fingertip applies a compressive force to the paper to engage the paper. However, where large volumes of papers are to be handled the finger can become easily fatigued. This can be especially true in banking, clerical, and secretarially work.

In some cases, individuals may lick their fingertips an attempt to re-moisturize their fingertip with the goal of at least temporarily increasing the coefficient of friction between their fingertip and the paper. Besides generally being considered as poor social etiquette, such practices are unsanitary as the transfer of saliva of a sick person (particularly to a book or magazine shared by a number of people) may increase the spread of disease.

The present disclosure addresses these concerns.

SUMMARY OF THE DISCLOSURE

One embodiment of the present disclosure provides a finger moisturizer container selectively positionable on a wrist of a user via an adjustable wristband. Another embodiment of the present disclosure provides a finger moisturizer container located on a clip, which can be selectively clipped to an article of clothing, cover or pages of the book (e.g., hardcover or paperback, with pages included under a clip), etc.

The summary above is not intended to describe each illustrated embodiment or every implementation of the present disclosure. The figures and the detailed description that follow more particularly exemplify these embodiments.

BRIEF DESCRIPTION OF THE DRAWINGS

The disclosure can be more completely understood in consideration of the following detailed description of various embodiments of the disclosure, in connection with the accompanying drawings, in which.

Figure 1:
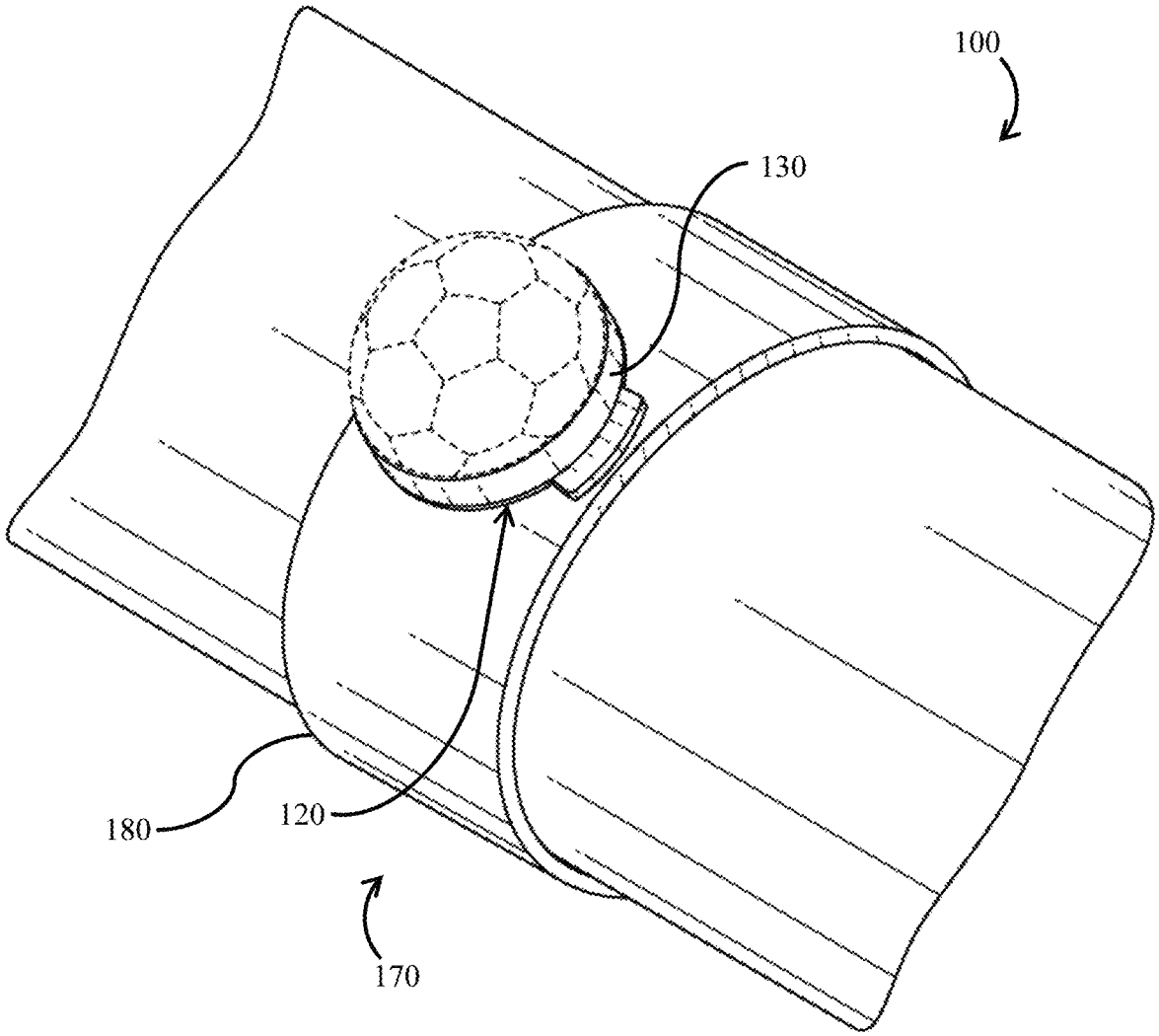
FIG. 1 is a perspective view depicting a finger moistener container, in accordance with a first embodiment of the disclosure, in which a wristband portion of the finger moistener container is in a closed, banded configuration, and a container of the finger moistener container is in a closed configuration.

While embodiments of the disclosure are amenable to various modifications and alternative forms, specifics thereof shown by way of example in the drawings will be described in detail. It should be understood, however, that the intention is not to limit the disclosure to the particular embodiments described. On the contrary, the intention is to cover all modifications, equivalents, and alternatives falling within the spirit and scope of the subject matter as defined by the claims.

DETAILED DESCRIPTION

Referring to FIGS. 1-6, a finger moisturizer container 100 selectively positionable on a wrist of a user via an adjustable wristband 170 is depicted in accordance with an embodiment of the disclosure. In some embodiments, the fingertip moisturizer container 100 can include a wristband portion 180 and a container 110.

The wristband portion 180 can be constructed out of a variety of flexible materials. For example, in one embodiment, the wristband portion 180 can be constructed of nylon webbing having a length sufficient to encircle the wrist and/or lower arm portion of the user. For example, in one embodiment, the wristband portion 180 can have a length of between about 8 inches and about 12 inches; although the use of other lengths of material to construct the wristband 170 is also contemplated. In some embodiments, the wristband portion 180 can have a width of between about ½ of an inch and about 2 inches; although the use of other widths of material to construct the wristband 170 is also contemplated.

In some embodiments, the wristband portion 180 can include one or more fasteners 182 configured to enable securement of a first end 184 of the wristband portion 180 to a second end 186 of the wristband portion 180, thereby enabling the wristband portion 180 to assume a closed, banded configuration encircling a wrist and/or lower arm of a user. For example, in some embodiments, the one or more fasteners 182 can be a hook-and-loop type fastener (e.g., Velcro®); although the use of other types of fasteners, including snaps, buttons, hooks, and the like are also contemplated.

Figure 2:
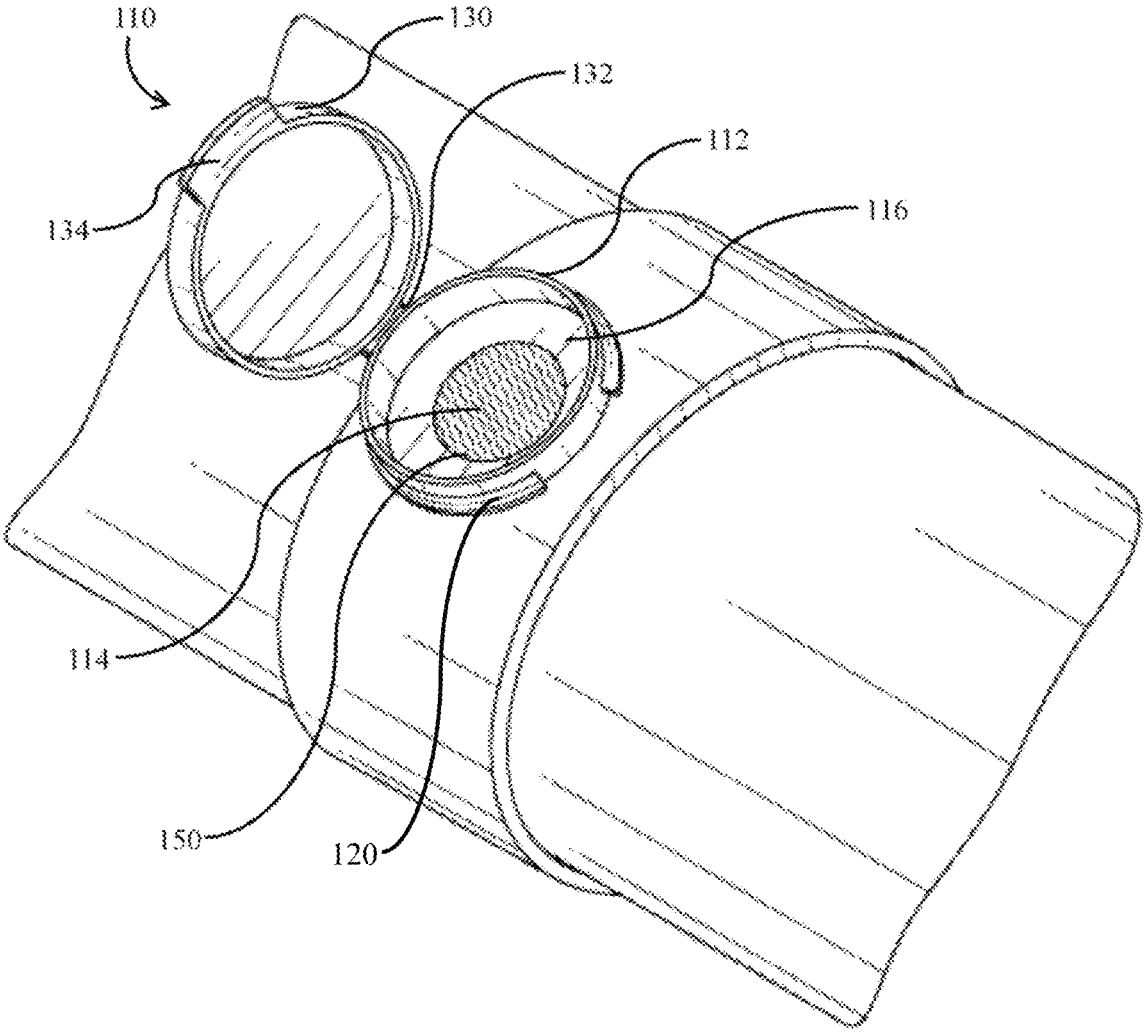
FIG. 2 is a perspective view of the finger moistener container of FIG. 1, in which the container of the finger moistener container is in an open configuration.
Figure 3:
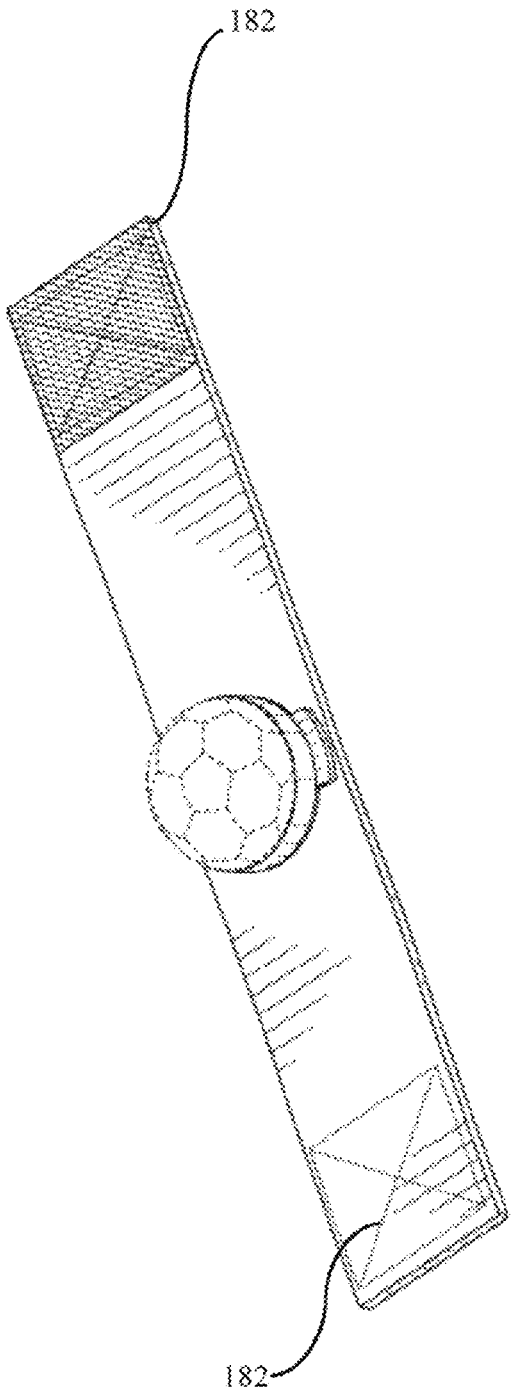
FIG. 3 is a top, perspective view depicting the finger moistener container of FIG. 1 in which the wristband portion is in a flat, open configuration.
Figure 4:
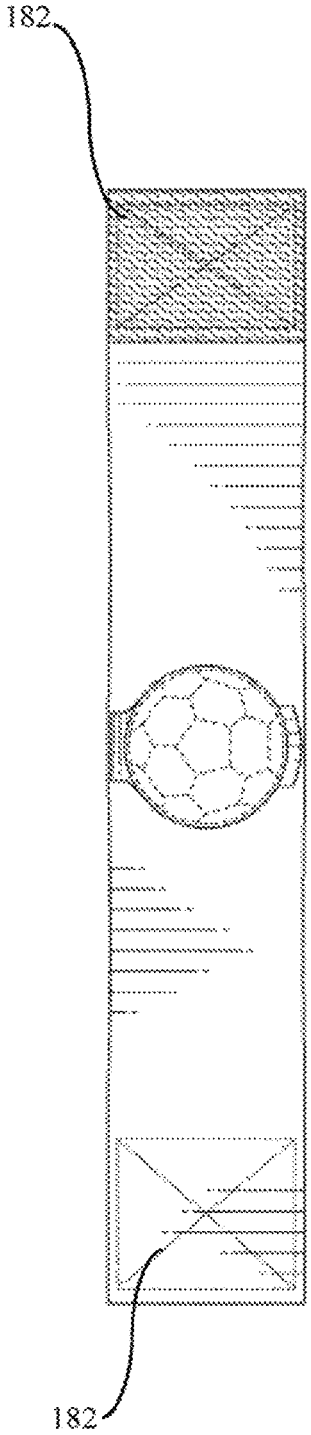
FIG. 4 is a top, plan view depicting the finger moistener container of FIG. 1.
Figure 5:
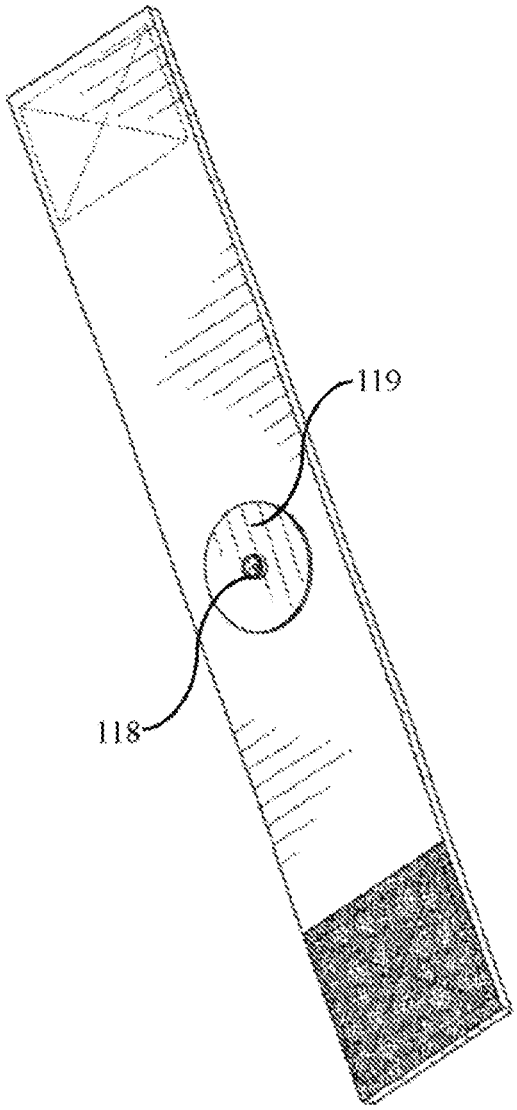
FIG. 5 is a bottom, perspective view depicting the finger moistener container of FIG. 1.
Figure 6:
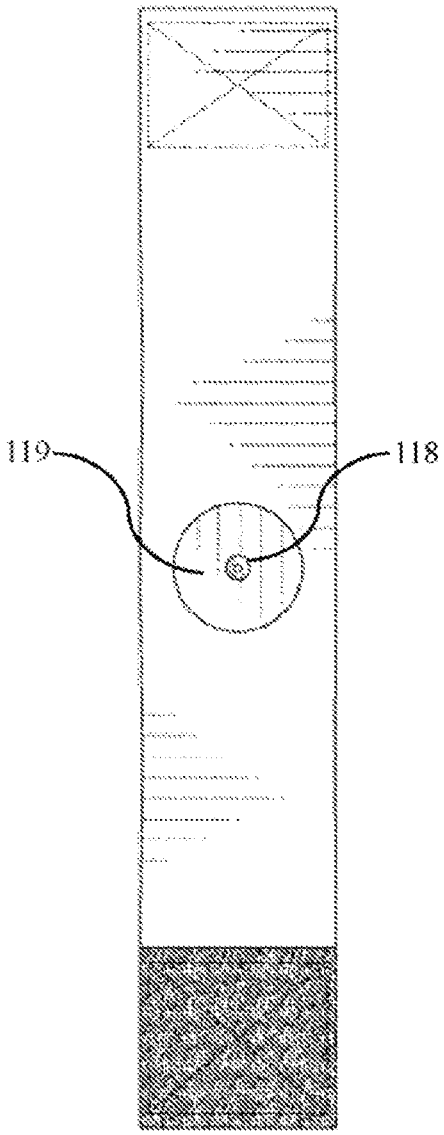
FIG. 6 is a bottom, plan view depicting the finger moistener container of FIG. 1.
Figure 7:
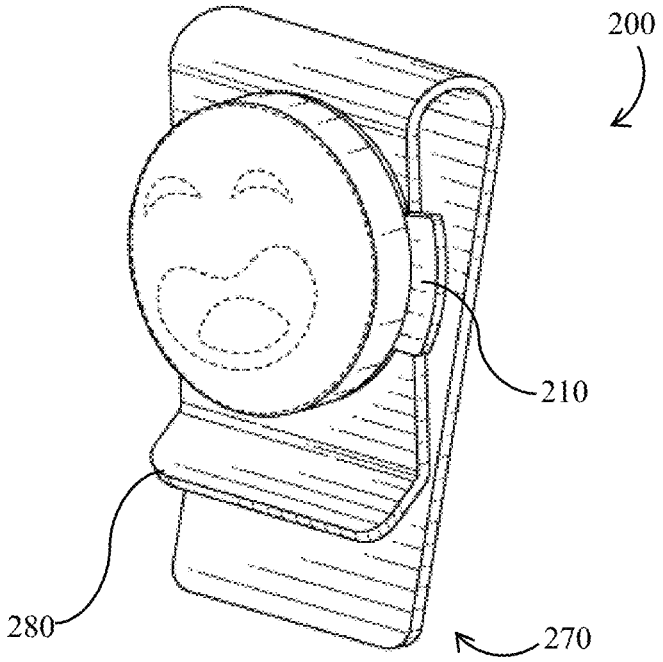
FIG. 7 is a perspective view depicting a finger moistener container, in accordance with the second embodiment of the disclosure, in which a container of the finger moistener container is in a closed configuration.
Figure 8:
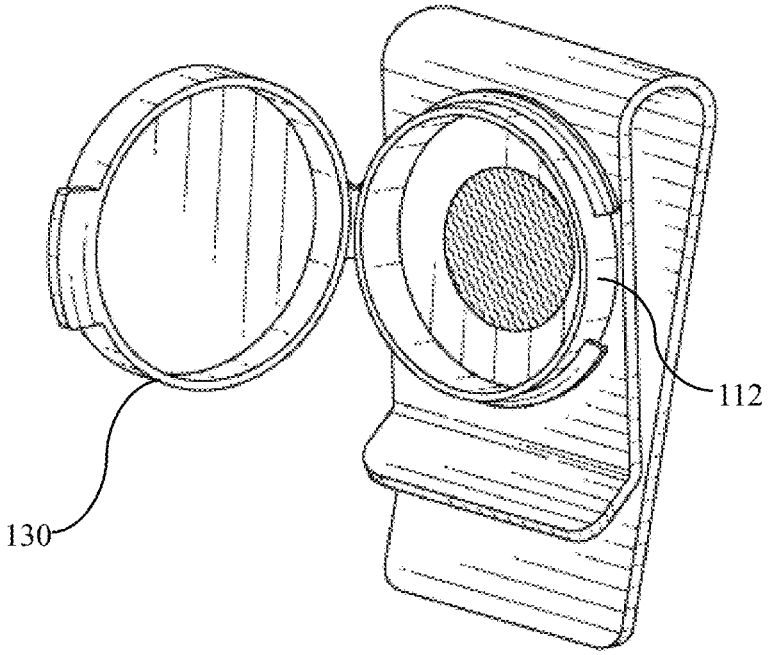
FIG. 8 is a perspective view of the finger moistener container of FIG. 7, in which the container of the finger moistener container is in an open configuration.
Figure 9:
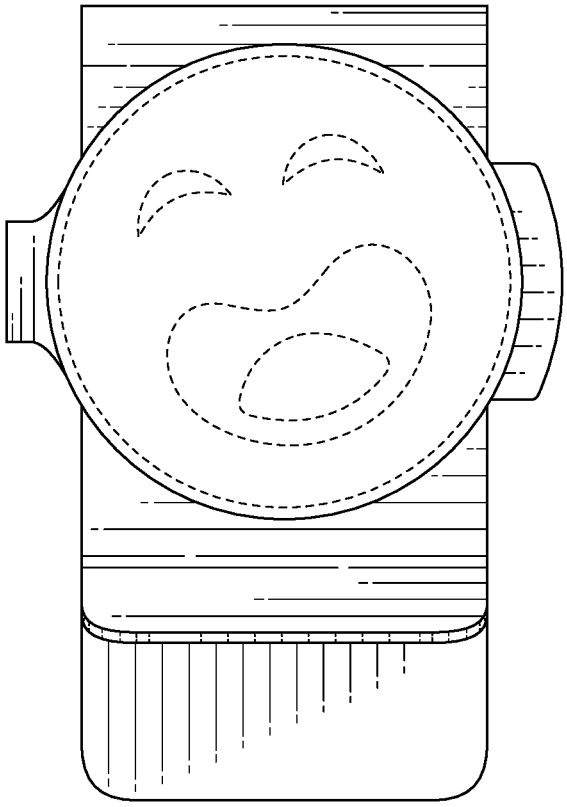
FIG. 9 is a top, plan view depicting the finger moistener container of FIG. 7.
Figure 10:
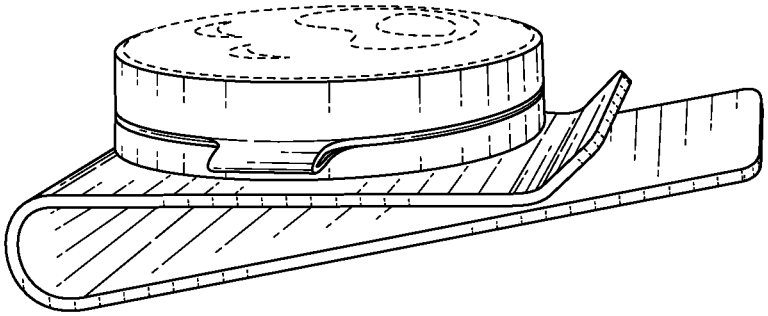
FIG. 10 is a profile view depicting the finger moistener container of FIG. 7.
Figure 11:
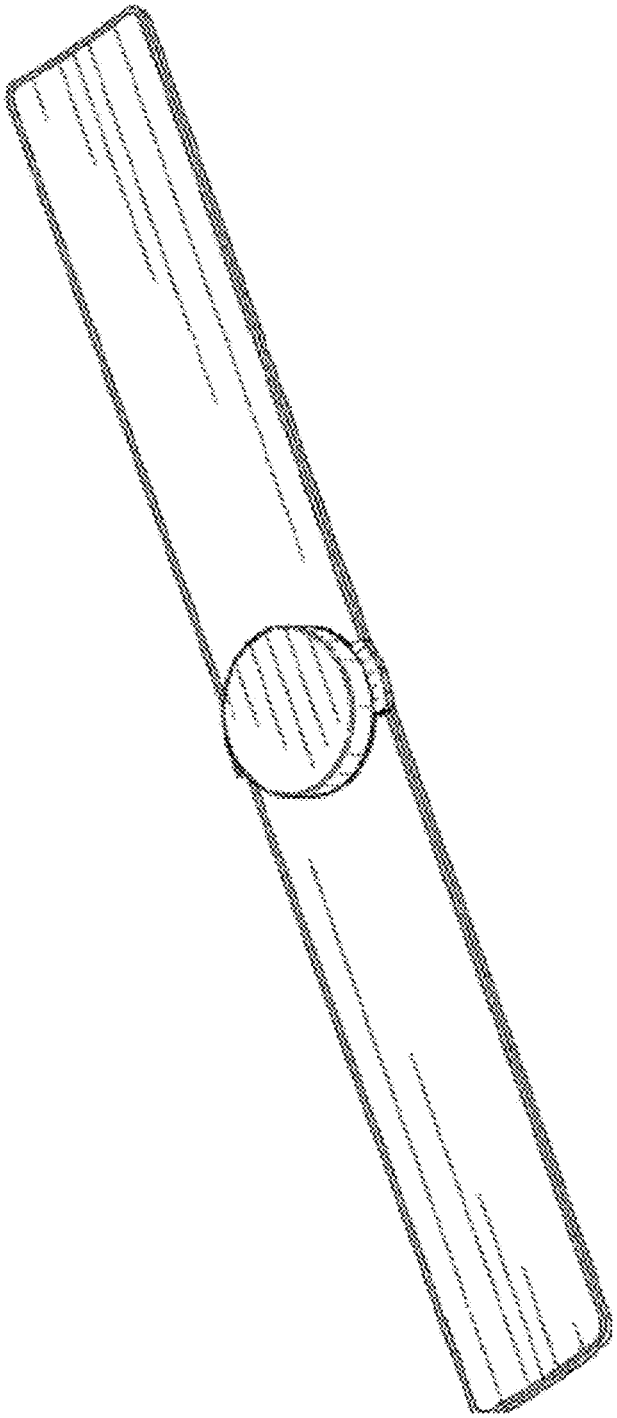
FIG. 11 is a top, perspective view depicting the finger moistener container, in accordance with a third embodiment of the disclosure, in which the wristband portion is in a flat, open configuration.
Figure 12:
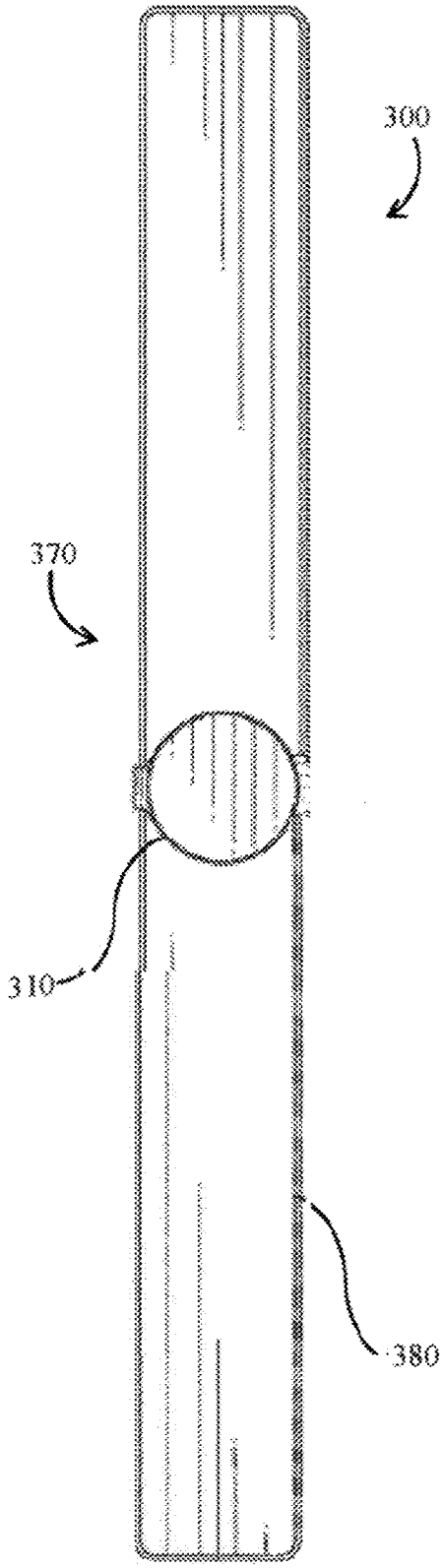
FIG. 12 is a top, plan view depicting the finger moistener container of FIG. 11.
Figure 13:
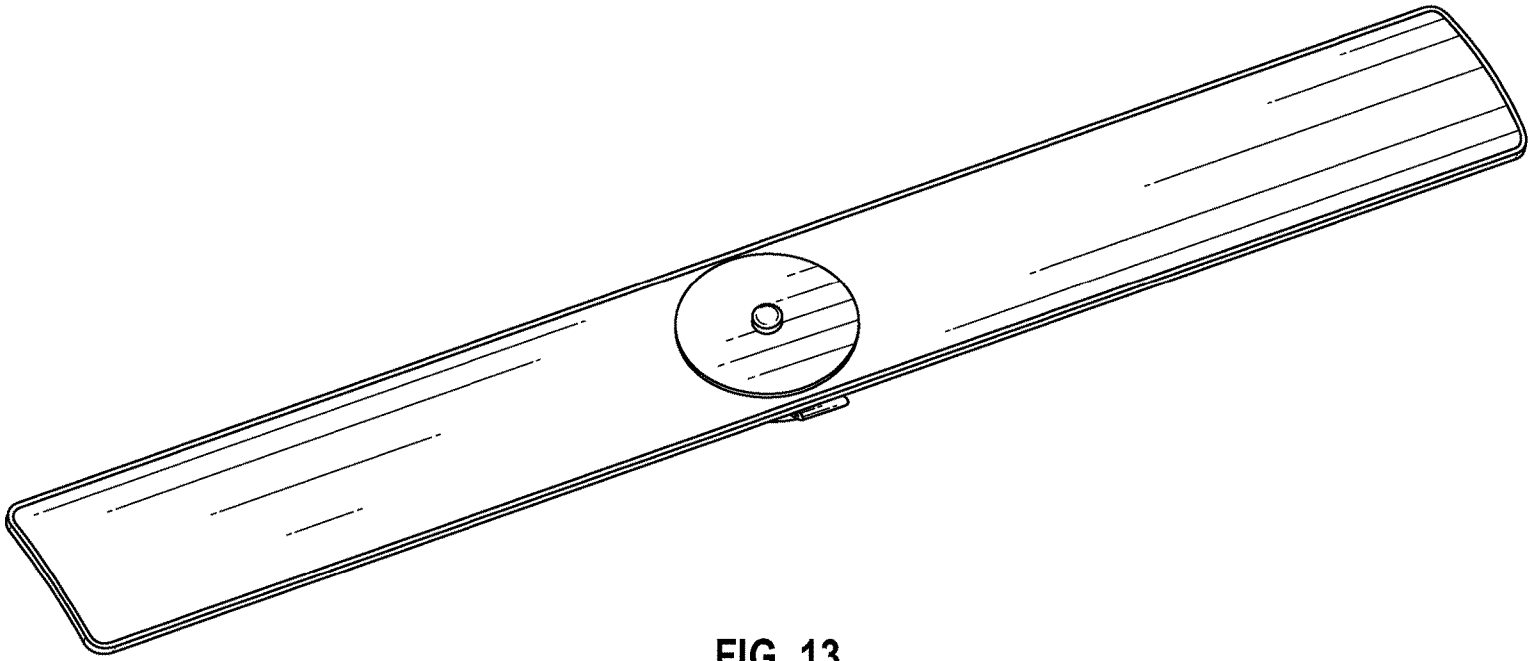
FIG. 13 is a bottom, perspective view depicting the finger moistener container of FIG. 11.
Figure 14:
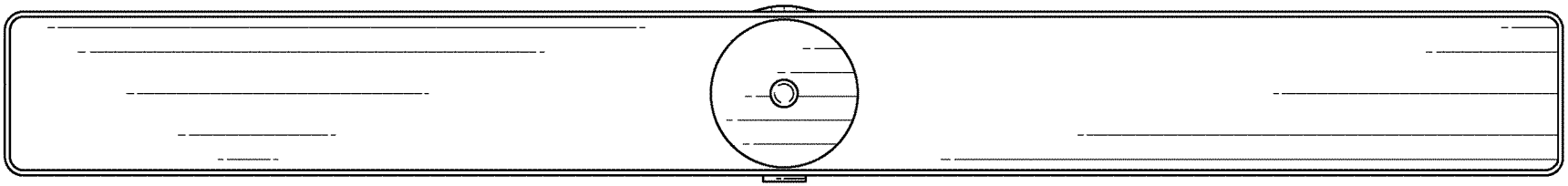
FIG. 14 is a bottom, plan view depicting the finger moistener container of FIG. 11.
Figure 15:
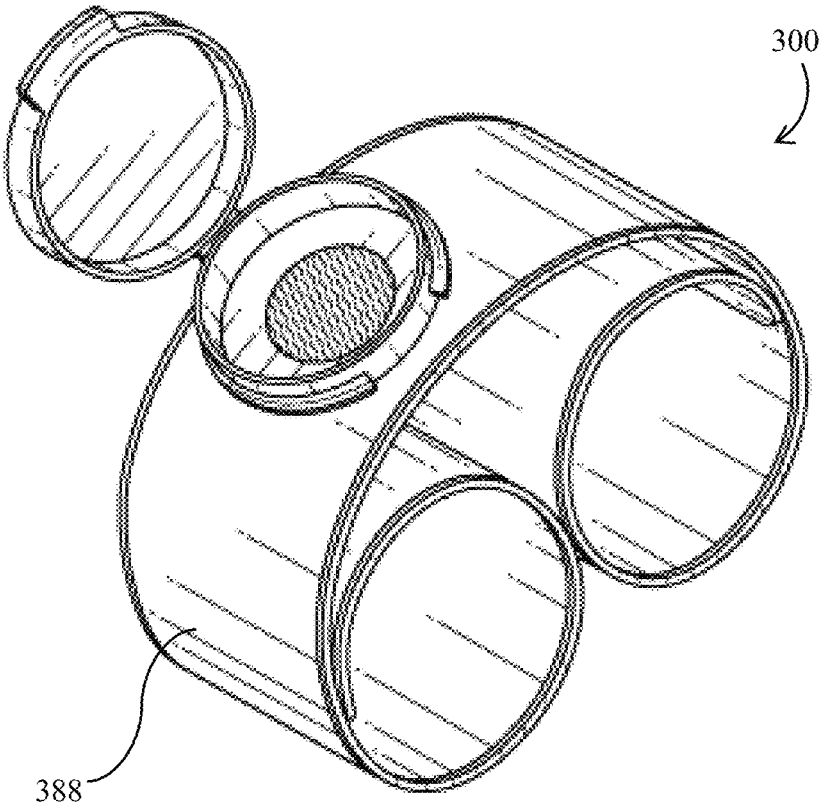
FIG. 15 is a perspective view of the finger moistener container of FIG. 11, in which the container of the Finger moistener container is in an open configuration.
Figure 16:
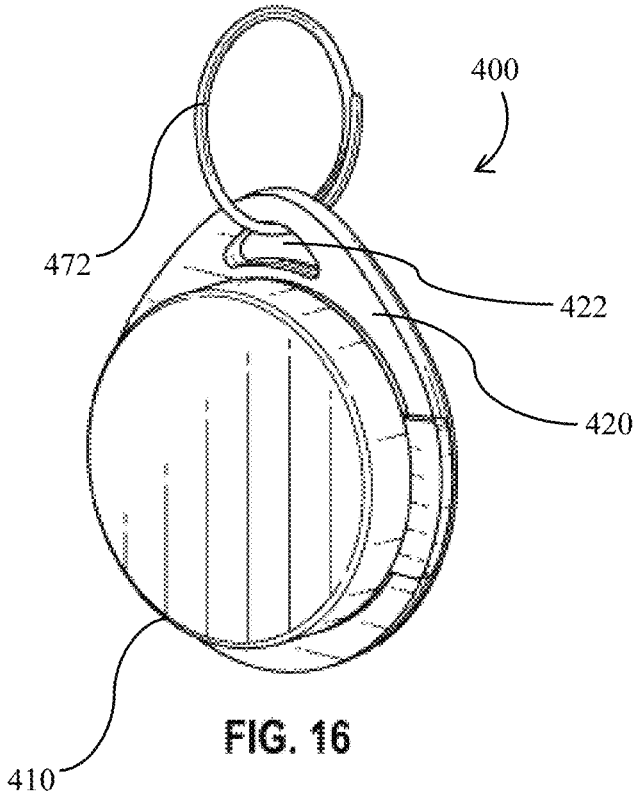
FIG. 16 is a perspective view depicting a finger moistener container, in accordance with the fourth embodiment of the disclosure, in which a container of the finger moistener container is in a closed configuration.
Figure 17:
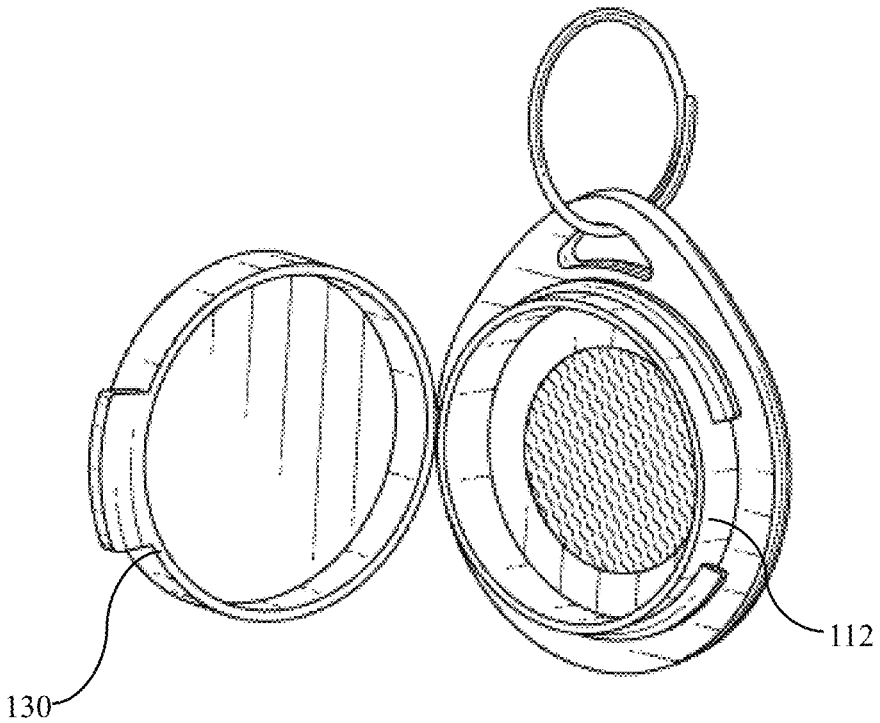
FIG. 17 is a perspective view of the finger moistener container of FIG. 16, in which the container of the finger moistener container is in an open configuration.
Figure 18:
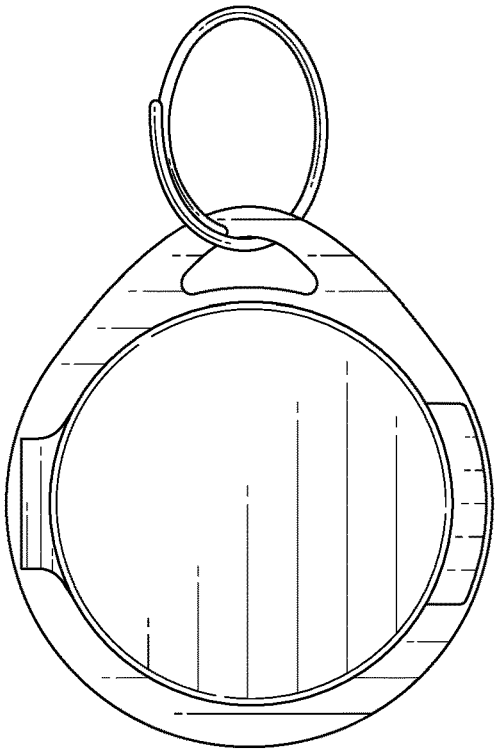
FIG. 18 is a top, plan view depicting the finger moistener container of FIG. 16.
Figure 19:
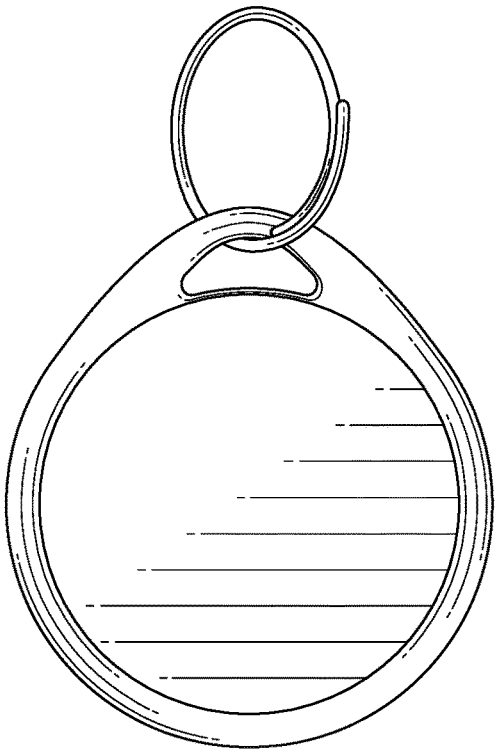
FIG. 19 is a bottom, plan view depicting the finger moistener container of FIG. 16.

In some embodiments, the container 110 can be in the form of a relatively small, plastic container having a flip-top lid 130; although the use of other sizes and materials in the construction of the container are also contemplated. In one embodiment, the container 110 can include a living hinge 132 configured to inhibit separation of a lid 130 of the container 110 from a container body 112. In some embodiments, container lid 130 can include one or more protrusions 134 to aid a user in manipulation of the lid 130 relative to the container body 112. With particular reference to FIGS. 1 and 2, in some embodiments, container body 112 can include a ridge 120 positioned around an outer perimeter of the body 112. The ridge 120 can be positioned between bottom and top surfaces of the body 112. The ridge 120 can be placed in contact with a bottom surface of the lid 130 when container 110 is in a closed configuration, as illustrated in FIG. 1, such that the bottom surface of the lid 130 is not coincident or aligned with the bottom surface of the body 112 (i.e., there exists a separation distance between the bottom surface of the lid 130 and the bottom surface of the body 112 when container 110 is in the closed configuration).

In some embodiments, the container 110 can generally circular in shape; although the use of other shapes including elliptical, square, rectangular, polygonal, and other shapes are also contemplated. In some embodiments, the container 110 can have a diameter of between about ½ of an inch and about 2 inches; although the use of other container sizes is also contemplated. In some embodiments, one or more characters, artwork, or designs can be adhered to a lid 130 to the container 110, as an aid in appealing to a wide variety of customers with different interests, as well as providing a distinguishing feature for a personalized touch.

In some embodiments, the container 110 can be filled with a fingertip moistener 150, configured to keep the end of the finger moistened for positive contact with surfaces and materials. For example, in one embodiment, the container 110 can be filled with Sortwik®; although the use of other types of fingertip moisteners are also contemplated. In embodiments, the fingertip moistener 150 can be nonstaining, safe, hygienic, and non-toxic.

To inhibit separation of the fingertip moistener 150 from the container 110 (e.g., a solid puck of the fingertip moistener 150 slipping out of the container 110), in some embodiments, a retainer element 114 can be positioned in a bottom of the container 110. For example, in some embodiments, a small piece of felt, hook type material, or the like can be secured to a bottom 116 of the container body 112, thereby providing an anchor for the fingertip moistener 150 to adhere or a medium into which the fingertip moistener 150 can be embedded.

In some embodiments, the container can be secured to the wristband portion 180 by a variety of methods. For example, in one embodiment, the container 110 can be riveted to the wristband 170; although the use of other methods as adhering the container 110 to the wristband 170 is also contemplated. Where a rivet 118 is used, a washer 119 can be positioned on a backside of the wristband 170 (to be positioned against a wrist and/or lower arm of a user when worn) to inhibit separation of the rivet 118 from the wristband 170.

Referring to FIG. 7-10, a finger moisturizer container located 200 on a clip 270 (e.g., a money clip), which can be selectively clipped to an article of clothing, pages of the book, etc., is depicted in accordance with an embodiment of the disclosure. In some embodiments, the fingertip moisturizer container 200 can include a clip portion 280 and a container 210. In some embodiments, the portion of the clip 270 opposite to the container 210 can be substantially flat, thereby enabling the clip 270 to serve as a page marker in a book, magazine, etc., without denting or otherwise leaving a mark on the pages of the book.

Referring to FIG. 11-15, a finger moisturizer container 300 selectively positionable on a wrist of a user via a slap bracelet wristband 370 is depicted in accordance with an embodiment of the disclosure. In some embodiments, the fingertip moisturizer container 300 can include a wristband portion 380 and a container 310.

The wristband portion 380 can be constructed out of a variety of resilient materials. For example, in one embodiment, the wristband portion 380 can be constructed of a steel blade 388 having a curved cross-section configured to naturally bias the steel blade 388 into a curled configuration. The steel blade 388 can be coated with a variety of soft flexible materials, such as a latex or other type of rubber material. In embodiments, the wristband portion 380 can have a length sufficient to encircle the wrist and/or lower arm portion of the user. In some embodiments, the wristband portion 380 can have a length of between about 7 inches and about 12 inches, for example a length of about 8 inches; although the use of other lengths of material to construct the wristband 370 is also contemplated. In some embodiments, the wristband portion 380 can have a width of between about ½ of an inch and about 2 inches, for example, a width of about 1 inch; although the use of other widths of material to construct the wristband 370 is also contemplated.

Referring to FIGS. 16-19, a finger moisturizer container 400 attached to a lanyard selectively positioned around a neck or other portion of the user, is depicted in accordance with an embodiment of the disclosure. In some embodiments, the container portion 410 can be adhered or otherwise affixed to a supporting member 420 defining an aperture 422. In some embodiments, one or more rings 472 or other connection members can pass through the aperture 422. Other configurations of the lanyard attachment are also contemplated.

Figure 20:
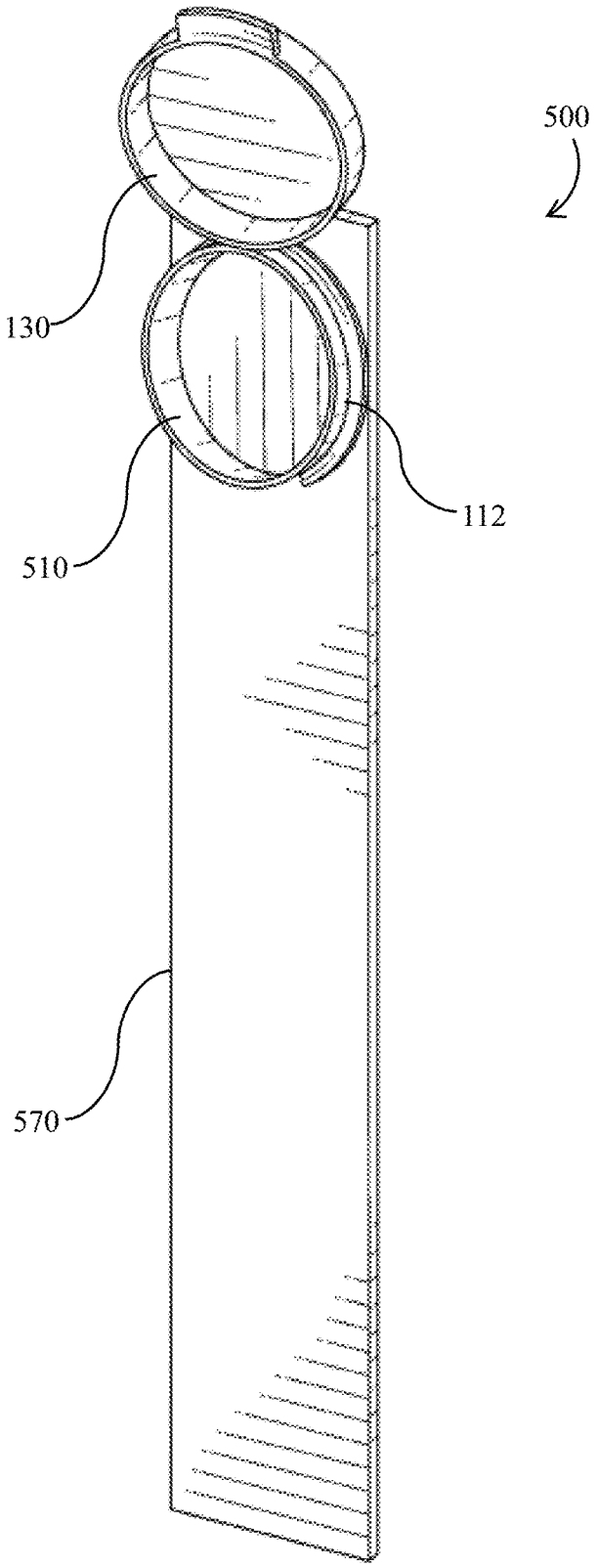
FIG. 20 is a perspective view depicting a finger moistener container, in accordance with the fifth embodiment of the disclosure, in which a container of the finger moistener container is in an open configuration.
Figure 21:
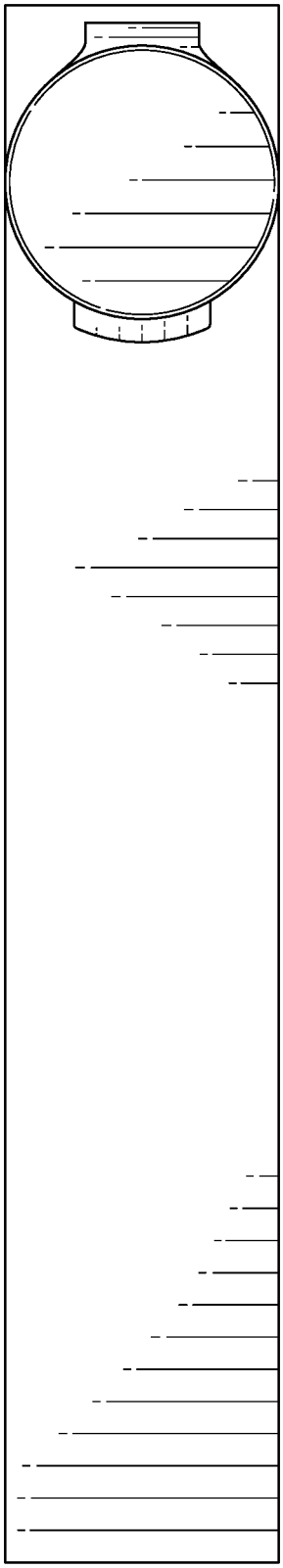
FIG. 21 is a top, plan view depicting the finger moistener container of FIG. 20, in which the container of the Finger moistener container is in a closed configuration.
Figure 22:
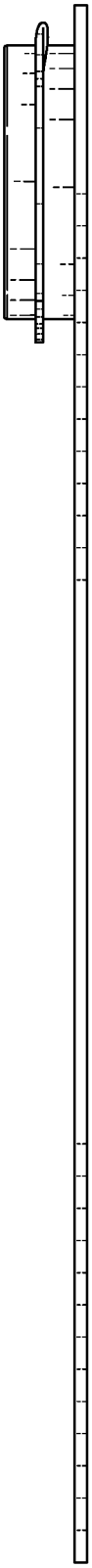
FIG. 22 is a profile view depicting the finger moistener container of FIG. 20, in which the container of the Finger moistener container is in a closed configuration.

Referring to FIGS. 20-22, a finger moisturizer container 500 attached to a bookmark 570 positionable between the pages of a book, magazine or other collection of papers, is depicted in accordance with an embodiment of the disclosure. In some embodiments, the container portion 510 can be adhered or otherwise affixed to a bookmark supporting member. The bookmark supporting member can be constructed out of a variety of materials, including card stock, paper, plastic, metal, or the like.

Various embodiments of systems, devices, and methods have been described herein. These embodiments are given only by way of example and are not intended to limit the scope of the claimed inventions. It should be appreciated, moreover, that the various features of the embodiments that have been described may be combined in various ways to produce numerous additional embodiments. Moreover, while various materials, dimensions, shapes, configurations and locations, etc. have been described for use with disclosed embodiments, others besides those disclosed may be utilized without exceeding the scope of the claimed inventions.

Persons of ordinary skill in the relevant arts will recognize that the subject matter hereof may comprise fewer features than illustrated in any individual embodiment described above. The embodiments described herein are not meant to be an exhaustive presentation of the ways in which the various features of the subject matter hereof may be combined. Accordingly, the embodiments are not mutually exclusive combinations of features; rather, the various embodiments can comprise a combination of different individual features selected from different individual embodiments, as understood by persons of ordinary skill in the art. Moreover, elements described with respect to one embodiment can be implemented in other embodiments even when not described in such embodiments unless otherwise noted.

Although a dependent claim may refer in the claims to a specific combination with one or more other claims, other embodiments can also include a combination of the dependent claim with the subject matter of each other dependent claim or a combination of one or more features with other dependent or independent claims. Such combinations are proposed herein unless it is stated that a specific combination is not intended.

Any incorporation by reference of documents above is limited such that no subject matter is incorporated that is contrary to the explicit disclosure herein. Any incorporation by reference of documents above is further limited such that no claims included in the documents are incorporated by reference herein. Any incorporation by reference of documents above is yet further limited such that any definitions provided in the documents are not incorporated by reference herein unless expressly included herein.

For purposes of interpreting the claims, it is expressly intended that the provisions of 35 U.S.C. § 112(f) are not to be invoked unless the specific terms "means for" or "step for" are recited in a claim.

What is claimed is:

1. A fingertip moisturizer container, comprising:

a container portion having a body and a lid, the lid being coupled to the body, the body having a bottom surface separated from a top surface by a first wall positioned on the perimeter of the body, the lid having a bottom surface separated from a top surface by a second wall positioned on the perimeter of the lid, the first wall and the second wall each defining an inner circumferential surface and an outer circumferential surface separated by a distance equivalent to a thickness of each respective wall, wherein the body includes a ridge positioned around the perimeter of the body between the bottom surface and the top surface of the body, wherein the lid is configured to alternate between an open configuration and a closed configuration, the closed configuration characterized by the inner circumferential surface of the second wall being mated to the outer circumferential surface of the first wall such that the lid covers and encloses the body, wherein the closed configuration is further characterized by the ridge being placed in contact with the bottom surface of the lid, such that the bottom surface of the lid is not coincident with the bottom surface of the body, thereby creating a separation distance between the bottom surfaces, the container portion having a retainer element coupled to an interior bottom of the body, the retainer element configured to securely couple a material to the interior bottom thereby inhibiting separation of the material from the container portion, and wherein the body of the container portion is configured to receive a finger therein when the lid is in the open configuration.

2. The fingertip moisturizer container of claim 1, further comprising a wristband portion having a first end and a second end, the first end and the second end being securable together to couple the wristband portion to a user, the container portion being coupled to the wristband portion.

3. The fingertip moisturizer container of claim 2, wherein the container portion is coupled to the wristband portion via one or more rivets.

4. The fingertip moisturizer container of claim 2, wherein the wristband portion comprises one or more fasteners configured to secure the first end of the wristband portion to the second end, thereby enabling the wristband portion to assume a closed, banded configuration encircling the user.

5. The fingertip moisturizer container of claim 4, wherein the one or more fasteners are a hook-and-loop type, a snap, a button, or a hook.

6. The fingertip moisturizer container of claim 2, wherein the wristband portion is constructed from a flexible material.

7. The fingertip moisturizer container of claim 2, wherein the wristband portion is constructed from a steel blade having a curved cross-section configured to naturally bias the steel blade into a curled configuration.

8. The fingertip moisturizer container of claim 7, wherein the steel blade is coated with a soft flexible material.

9. The fingertip moisturizer container of claim 2, wherein the wristband portion has a length between about 6 inches and about 12 inches, and a width between about 0.5 inches and about 2 inches.

10. The fingertip moisturizer container of claim 1, wherein the container portion is circular in shape with a diameter between about 0.5 inches and about 2 inches.

11. The fingertip moisturizer container of claim 1, wherein the container portion is square or rectangular in shape.

12. The fingertip moisturizer container of claim 1, wherein the lid of the container portion is coupled to the body via a hinge.

13. The fingertip moisturizer container of claim 1, wherein the container portion further comprises one or more characters, artwork, or illustrative designs.

14. The fingertip moisturizer container of claim 1, wherein the lid of the container portion further comprises one or more protrusions to aid the user in manipulation of the lid relative to the body.

15. The fingertip moisturizer container of claim 1, further comprising a fingertip moistener attached to the retainer element, the fingertip moistener configured to keep a finger of the user moistened for positive contact with surfaces and materials.

16. The fingertip moisturizer container of claim 1, wherein the retainer element is a felt material or a hook.

17. The fingertip moisturizer container of claim 1, further comprising a clip coupled to the container portion.

18. The fingertip moisturizer container of claim 1, further comprising a supporting member defining an aperture, wherein the container portion is coupled to the supporting member.

* * * * *